US006615516B1

(12) United States Patent
Houston et al.

(10) Patent No.: US 6,615,516 B1
(45) Date of Patent: Sep. 9, 2003

(54) MAILABLE DEVICE WITH GRAPHIC DISPLAY

(75) Inventors: Mark Houston, Fort Worth, TX (US); Leslie D. McDaniel, Arlington, TX (US); Bruce Neil, Abilene, TX (US)

(73) Assignee: MediaGarden, Inc., Fort Worth, TX (US)

( * ) Notice: Subject to any disclaimer, the term of this patent is extended or adjusted under 35 U.S.C. 154(b) by 0 days.

(21) Appl. No.: 10/162,370

(22) Filed: Jun. 4, 2002

(51) Int. Cl.[7] ..... G09F 1/00; B65D 27/04; B65D 15/00

(52) U.S. Cl. ..... 40/124.01; 40/124.06; 40/538; 229/71; 229/92.8

(58) Field of Search ..... 40/124.01, 124.06, 40/124.191, 360, 538, 675; 229/71, 92.8, 921; 283/117; D19/2, 3, 4, 6

(56) References Cited

U.S. PATENT DOCUMENTS

| | | | | | |
|---|---|---|---|---|---|
| 1,473,800 | A | | 11/1923 | Webb | |
| D82,863 | S | | 12/1930 | Warren | |
| 1,866,493 | A | | 7/1932 | Staats | |
| 3,440,747 | A | | 4/1969 | Oliver | |
| 3,512,780 | A | * | 5/1970 | Allison | 273/139 |
| 3,977,521 | A | | 8/1976 | Murphy | |
| 4,140,317 | A | * | 2/1979 | Ramney | 273/243 |
| D252,155 | S | | 6/1979 | Okimoto | |
| 4,201,331 | A | | 5/1980 | Austin | |
| D272,806 | S | | 2/1984 | Handy et al. | |
| 4,448,834 | A | | 5/1984 | Pohl | |
| 4,612,220 | A | * | 9/1986 | Baxter | 428/33 |
| 4,640,030 | A | | 2/1987 | Wood et al. | |
| D297,413 | S | | 8/1988 | Cantrell, Sr. | |
| 4,981,211 | A | | 1/1991 | Janek | |
| D317,721 | S | | 6/1991 | Fiorillo et al. | |
| 5,054,611 | A | | 10/1991 | Russomanno et al. | |
| 5,096,229 | A | | 3/1992 | Carlson | |
| D329,016 | S | | 9/1992 | Scarpa et al. | |
| 5,219,168 | A | * | 6/1993 | Morris | 273/157 R |
| 5,377,821 | A | | 1/1995 | Fierek | |
| 5,613,312 | A | | 3/1997 | Crowell | |
| D379,198 | S | | 5/1997 | Dowda | |
| 5,626,232 | A | | 5/1997 | Volkert et al. | |
| D399,252 | S | | 10/1998 | Bashama | |
| D420,384 | S | | 2/2000 | Ristau | |
| D424,935 | S | | 5/2000 | Ristau | |
| 6,434,867 | B1 | * | 8/2002 | Ristau | 40/124.06 |

OTHER PUBLICATIONS www.pegweb.com/artsncrafts/card.html Jun. 1, 1999.
www.pegweb.com/artsncrafts/letter.html Jun. 1, 1999.
www.pegweb.com/artsncrafts/letter1.jpg Jun. 1, 1999.

* cited by examiner

*Primary Examiner*—Brian K. Green
(74) *Attorney, Agent, or Firm*—Locke Liddell & Sapp LLP

(57) ABSTRACT

A mailer for transmission from a sender to a recipient includes a front sheet having a perimeter and inner and outer opposed faces. The outer face of the front sheet is adapter to receive the address of the recipient. The front sheet is disposed in a first plane. The mailer includes a back sheet having a perimeter and inner and outer opposed faces. The back sheet is disposed in a second plane, which is spaced apart from and parallel to the first plane. A graphic display is disposed between the front sheet and the back sheet and adjacent to the inner face of the front sheet and adjacent to the inner face of the back sheet. The graphic display is disposed in a third plane parallel to the first and second planes. The graphic display includes projections extending within the third plane and outside the perimeter of the front sheet and outside the perimeter of the back sheet. The graphic display includes a plurality of irregularly shaped interlocking components.

6 Claims, 9 Drawing Sheets

MAILABLE DEVICE WITH GRAPHIC DISPLAY

TECHNICAL FIELD OF THE INVENTION

The present invention relates to a mailer, and more particularly to a graphic display for a mailer including interlocking components.

BACKGROUND OF THE INVENTION

Envelopes and other containers for transmitting written messages are typically known and are generally void of decorative graphics. Such envelopes do not assist in communicating a message to the recipient other than by printed words or a design or picture printed directly on the envelope.

A need has arisen for a mailer having a graphic design which is easy to assemble and has sufficient structural integrity to withstand handling by the postal service.

SUMMARY OF THE INVENTION

In accordance with the present invention, a mailer for transmission from a sender to a recipient includes a front sheet having a perimeter and inner and outer opposed faces. The outer face of the front sheet is adapter to receive the address of the recipient. The front sheet is disposed in a first plane. The mailer includes a back sheet having a perimeter and inner and outer opposed faces. The back sheet is disposed in a second plane, which is spaced apart from and parallel to the first plane. A graphic display is disposed between the front sheet and the back sheet and adjacent to the inner face of the front sheet and adjacent to the inner face of the back sheet. The graphic display is disposed in a third plane parallel to the first and second planes. The graphic display includes projections extending within the third plane and outside the perimeter of the front sheet and outside the perimeter of the back sheet. The graphic display includes a plurality of irregularly shaped interlocking components.

DESCRIPTION OF THE DRAWINGS

For a more complete understanding of the present invention and for further advantages thereof, reference is now made to the following Description of the Preferred Embodiments taken in conjunction with the accompanying Drawings in which.

DESCRIPTION OF THE PREFERRED EMBODIMENTS

Figure 1:
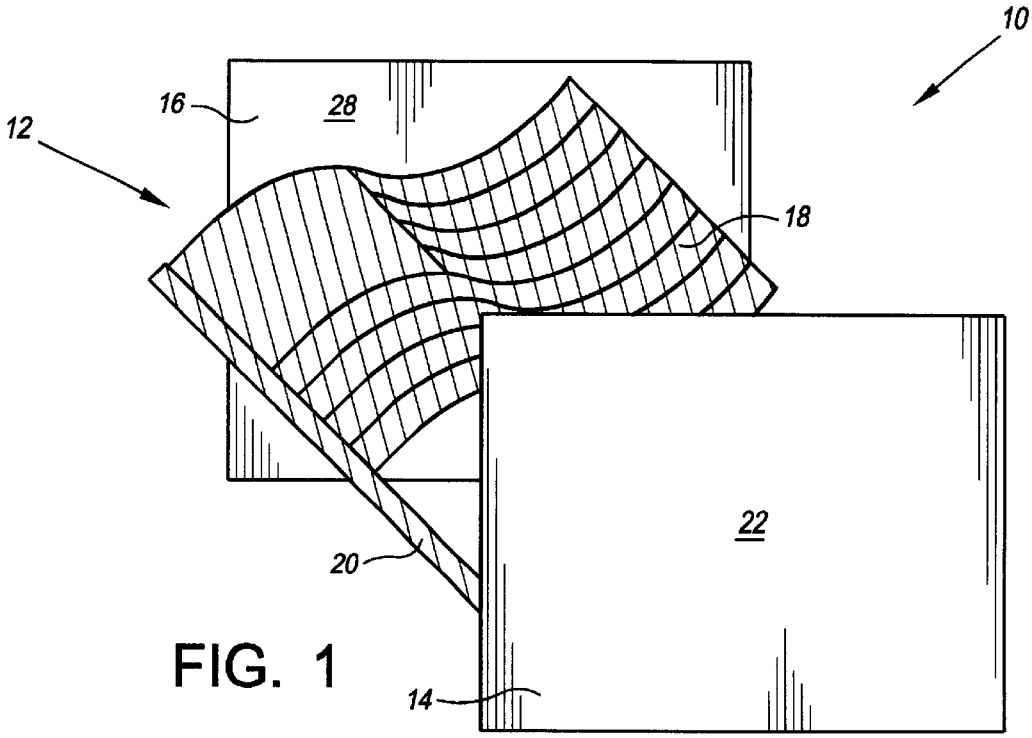
FIG. 1 is a front exploded perspective view of a mailer in accordance with the present invention.
Figure 2:
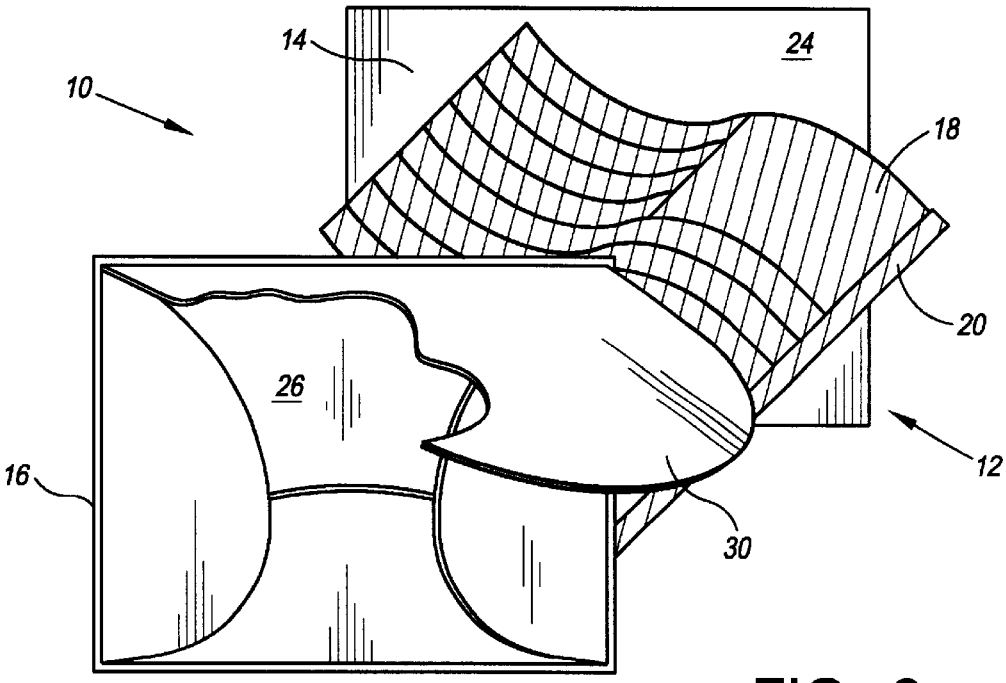
FIG. 2 is a rear exploded perspective view of the mailer of FIG. 1.

Referring simultaneously to FIGS. 1–3*a*, a mailer in accordance with the present invention is illustrated, and is generally identified by the numeral 10. Mailer 10 includes a flag graphic display 12. Graphic display 12 is disposed between a front sheet 14 and a back sheet 16 of mailer 10. Front sheet 14 is spaced apart from back sheet 16 for allowing graphic display 12 to be sandwiched therebetween. Flag graphic display 12 includes a flag 18 and pole 20.

Figure 3A:
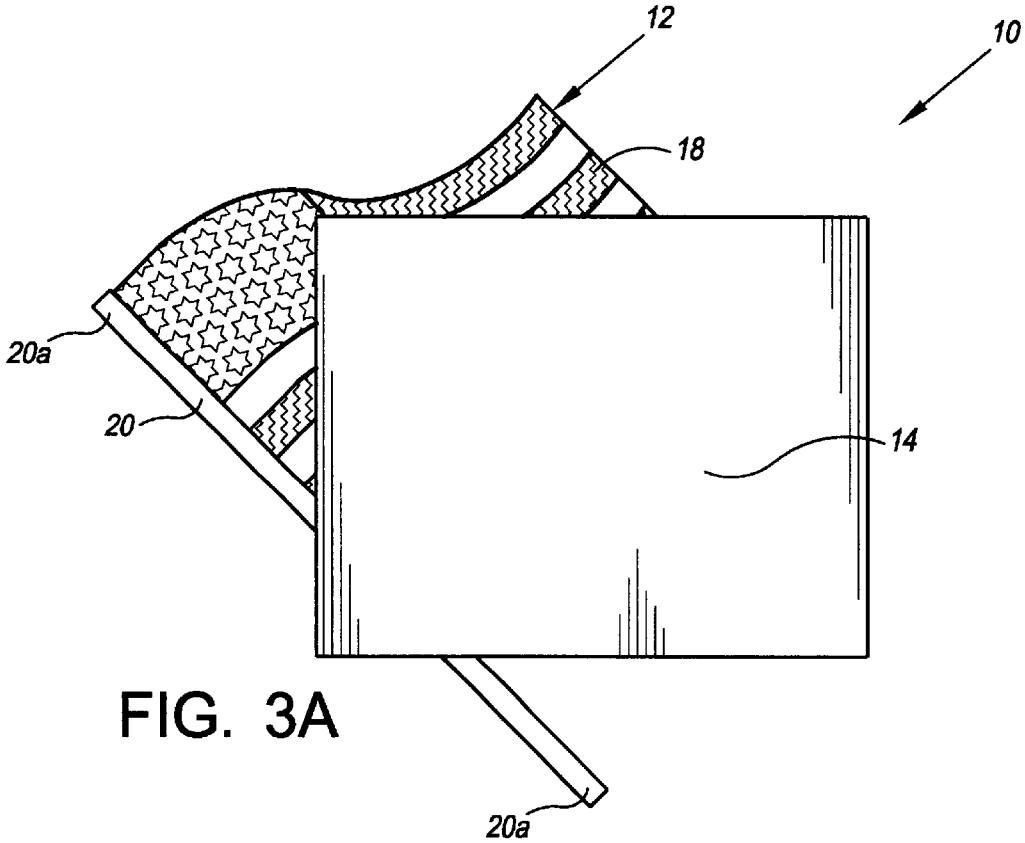
FIG. 3*a* is a plan view of the flag mailer shown in FIG. 1, illustrating a representative embodiment of the present invention.

As best illustrated in FIG. 3*a*, a portion 18*a* of flag 18 and a portion 20*a* of pole 20 extend outside the perimeter of front sheet 14 and back sheet 16. Portions 18*a* and 20*a* lie in a common plane which is parallel to the planes containing front sheet 14 and back sheet 16.

Front sheet 14 includes an outer face 22 for receiving the address of a recipient of mailer 10. Front sheet 14 includes an inner face 24. Back sheet 16 includes an outer face 26 and an opposed inner face 28. Inner face 24 of front sheet 14 and inner face 28 of back sheet 16 are disposed adjacent graphic display 12. Outer face 26 of back sheet 16 includes an envelope 30 for mailer 10; however, envelope 30 is not required, as mailer 10 can be utilized as a postcard in which outer face 26 of back sheet 16 would be utilized as a message location for the sender of mailer 10.

Inner face 24 of front sheet 14 and inner face 28 of back sheet 16 are adhesively secured to graphic display 12 such as, for example by utilizing double-sided adhesive including wet adhesives, pressure-sensitive adhesives, and the like.

Front sheet 14 and back sheet 16 may comprise, for example, semi-rigid material, such as card stock, paperboard, plastic, or cardboard to provide physical stabilization for mailer 10. Front sheet 14 and back sheet 16 are typically configured as having the same shape, length, width, and thickness; however, front sheet 14 and back sheet 16 may have differing shapes depending upon the overall design of mailer 10. Graphic display 12 may comprise, for example, flexible material such as foam.

Figure 3B:
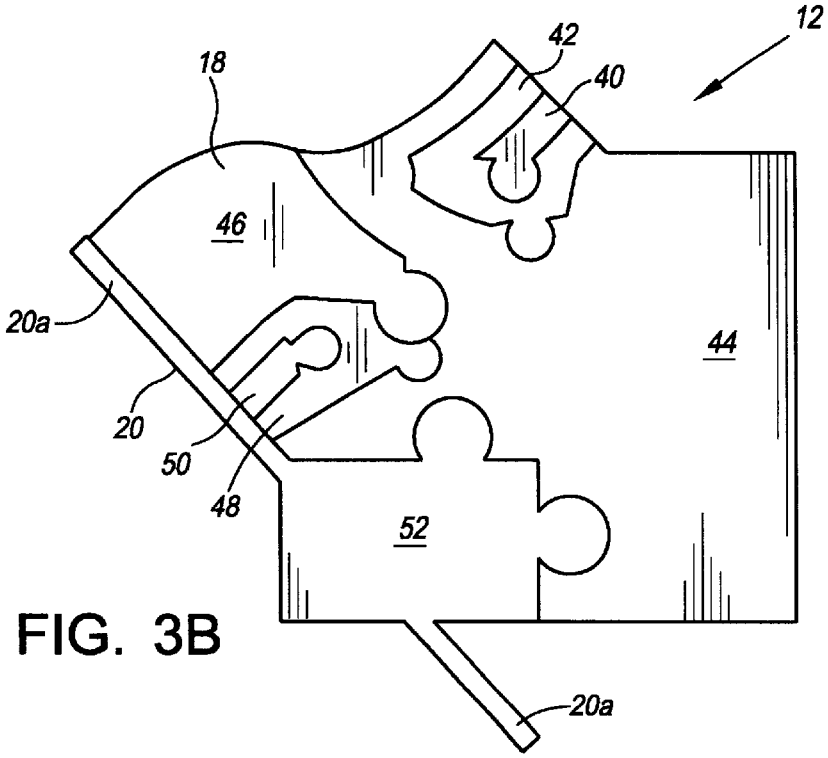
FIG. 3*b* is a plan view of the flag graphic display of FIG. 3*a* illustrating the components of the graphic display.
Figure 3C:
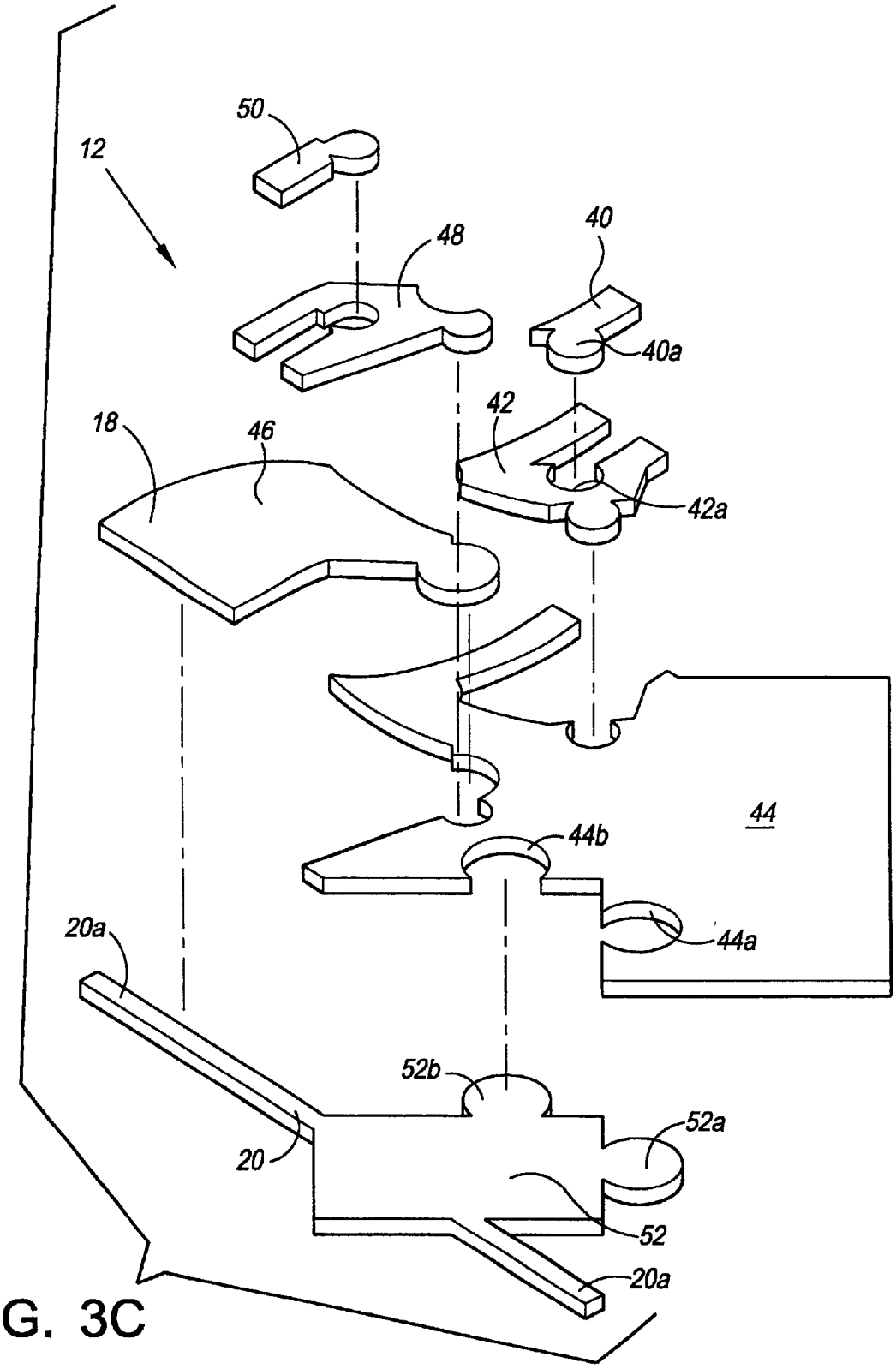
FIG. 3*c* is an exploded plan view of the components shown in FIG. 3*b;*

Referring now to FIGS. 3*b* and 3*c*, the present flag graphic display 12 includes a plurality of irregularly shaped and interlocking components 40–52. Components 40–52 interlock in much the same way as a jigsaw, puzzle. Components 40–52 may be of different colors to create graphic display 12, and be fabricated from different types of materials. Components 40–52 interlock by utilizing mating male and female portions including various shaped partial apertures. For example, component 40 includes a male portion 40*a* which is received by a partial aperture, female portion 42*a* of component 42. Similarly, component 52 includes male portions 52*a* and 52*b* which are received by female portions 44*a* and 44*b*, respectively of component 44. FIG. 3*c* illustrates an interconnection of components 40–52, it being understood the FIG. 3*c* illustrates one configuration of graphic display 12, it further being understood that fewer or more components can be utilized, and can be interconnected in a variety of configurations.

The use of interlocking components 40–52 facilitates the assembly of graphic display 12 by assisting the assembler in recognizing the appropriate placement of each piece in relation to the design of the entire graphic display 12. For example, two different, but similar components of a graphic display used in multi-pieced displays may utilize varying interlocking shapes and/or placement of interlocking shapes to assist the assembler in distinguishing between the two components and recognize where each component fits in the entire graphic display. Additionally, the use of interlocking components 40–52 assist to structurally maintain graphic display 12 intact prior to assembly to front sheet 14 and back sheet 16. Following assembly of front sheet 14 and back sheet 16, interlocking components 40–52 strengthen the structural integrity of mailer 10 by dispersing external tugging forces from specific ones of components 40–52 extending beyond the perimeter of front sheet 14 and back sheet 16 to adjacent ones of components 40–52 which are contained between front sheet 14 and back sheet 16. This distribution of external forces allows each component 40–52 to withstand forces greater than each component could withstand individually without the interlocking feature of the present invention.

An additional advantage of the present use of interlocking components 40–52 allows the use of relatively small components, such as, for example, component 40. Component 40 is anchored in a larger component 42 which, in turn, is anchored to component 44 to maintain component 40 in place, and allow component 40 to extend beyond the perimeter of front sheet 14 and back sheet 16.

Figure 4A:
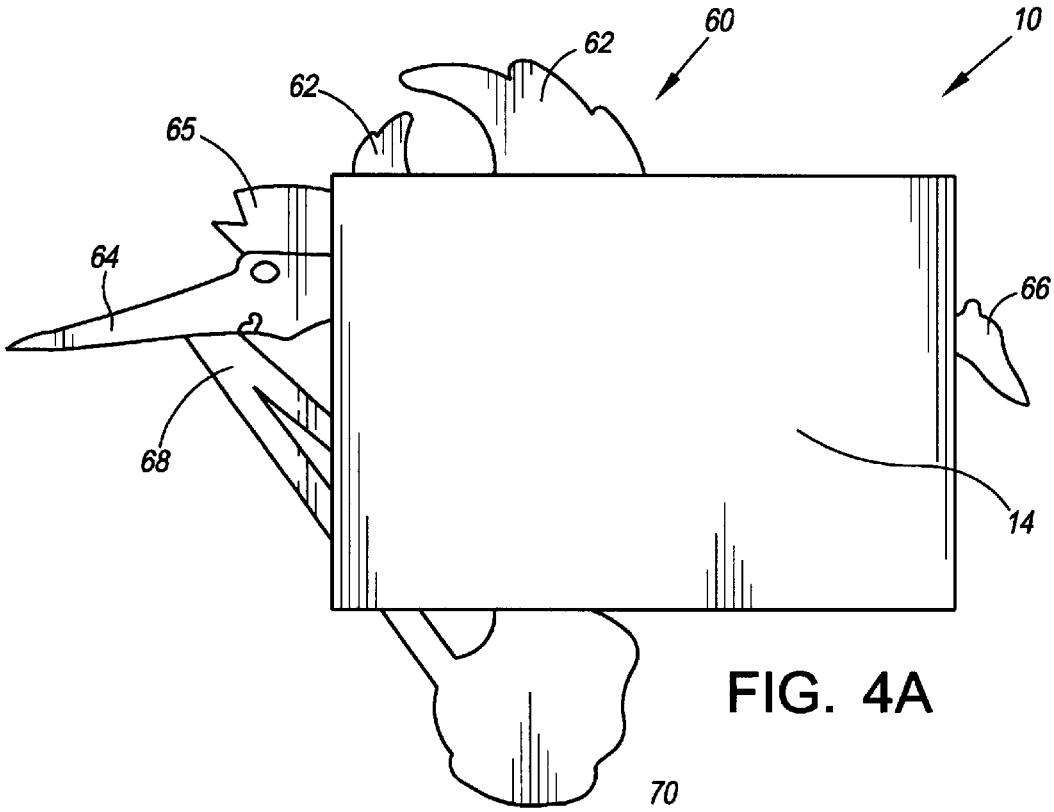
FIG. 4*a* is a plan view of a stork mailer illustrating a representative embodiment of the present invention.
Figure 4B:
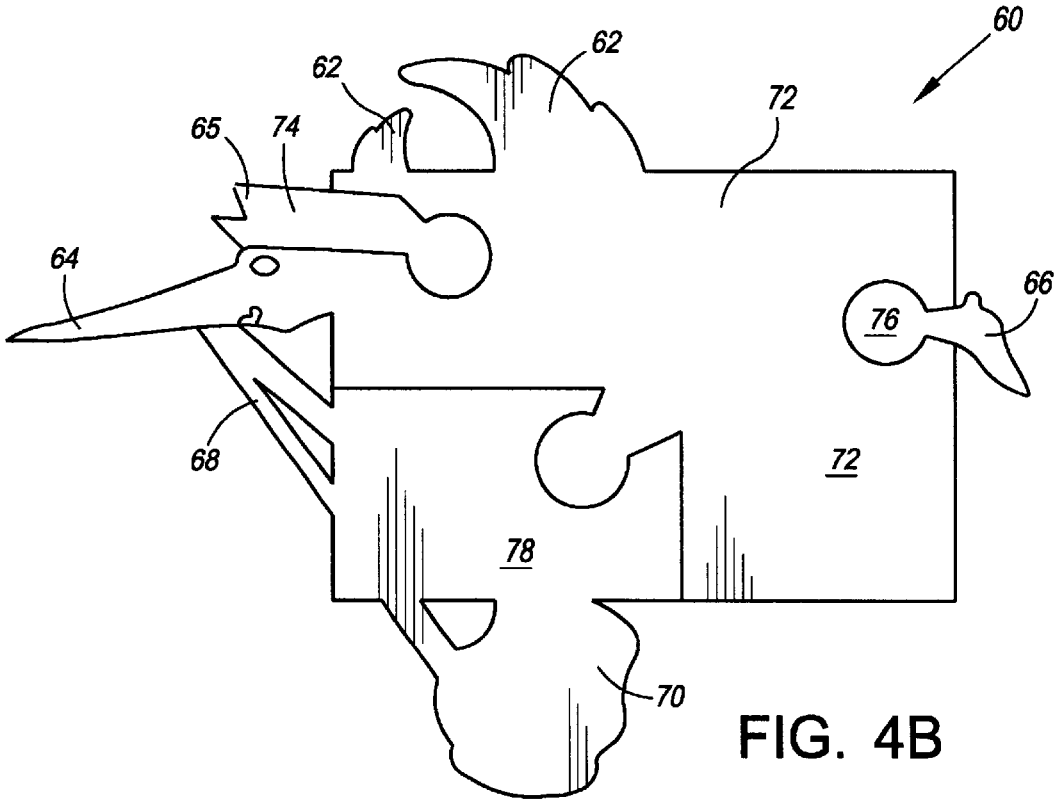
FIG. 4*b* is a plan view of the stork graphic display of FIG. 4*a* illustrating the components of the graphic display.
Figure 4C:
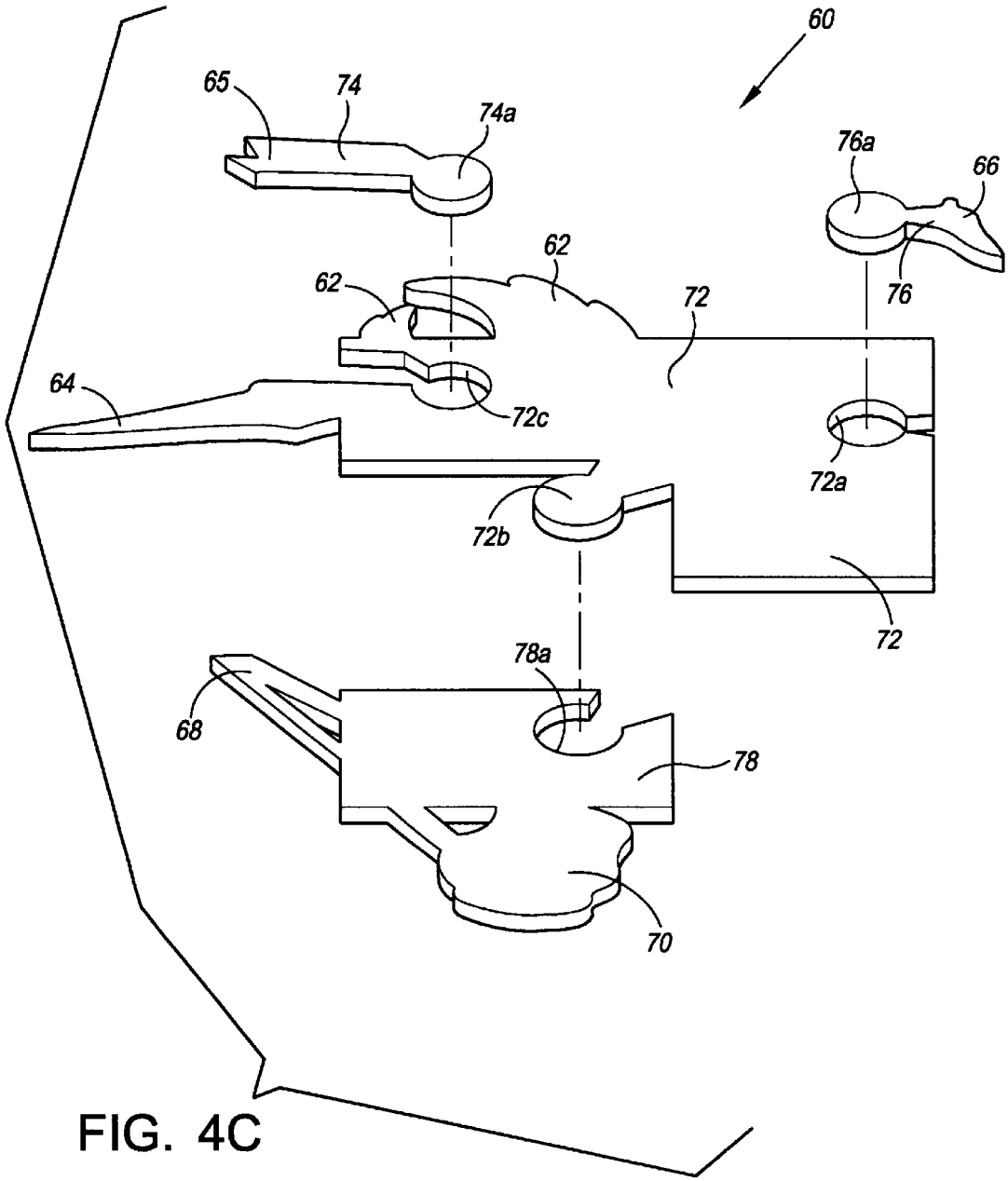
FIG. 4*c* is an exploded plan view of the components shown in FIG. 4*b;*

Referring now to FIGS. 4*a*–4*c*, mailer 10 is illustrated as including a stork graphic display 60, which may be utilized for announcing the birth of a child. Graphic display 60 includes portions extending beyond the perimeter of front sheet 14 and back sheet 16 and includes wings 62, stork head 64, hat 65, feet 66, a cord 68, and bag 70.

Referring simultaneously to FIGS. 4*b* and 4*c*, stork graphic display 60 includes irregularly shaped interlocking components 72–78. Component 76 represents the stock's feet 66 and includes a male portion 76*a* which engages a female portion 72*a* of component 72. Component 78 includes the cord 68 and bag 70 and includes a female portion 78*a* which engages a male portion 72*b* of component 72. Component 74 representing the stork's hat 65 includes a male portion 74*a* which engages a female portion 72*c* of component 72. Irregularly shaped interlocking components 72–78 function in a manner similar to components 40–52 with respect to flag graphic display 12. As previously stated, the shape of components 72–78 may vary depending upon the size, color, and portions of the graphic display extending outwardly from front sheet 14 and back sheet 16 of mailer 10.

Figure 5A:
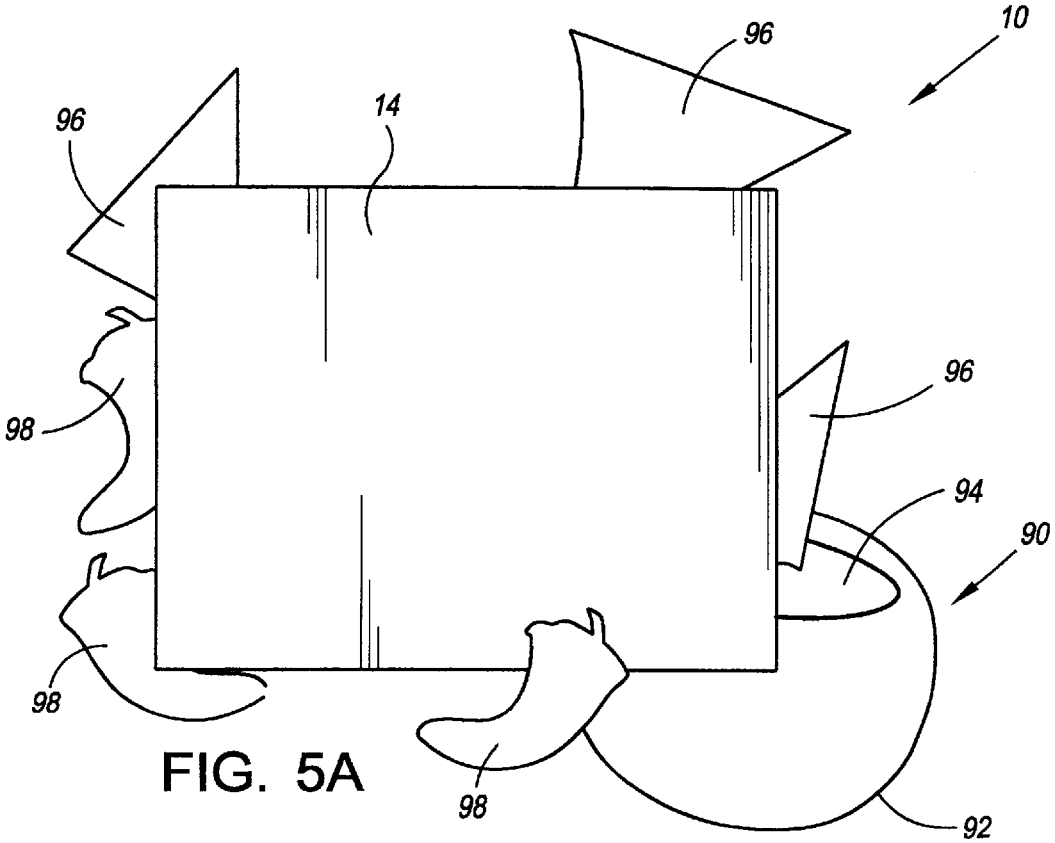
FIG. 5*a* is a plan view of a salsa mailer illustrating a representative embodiment of the present invention.
Figure 5B:
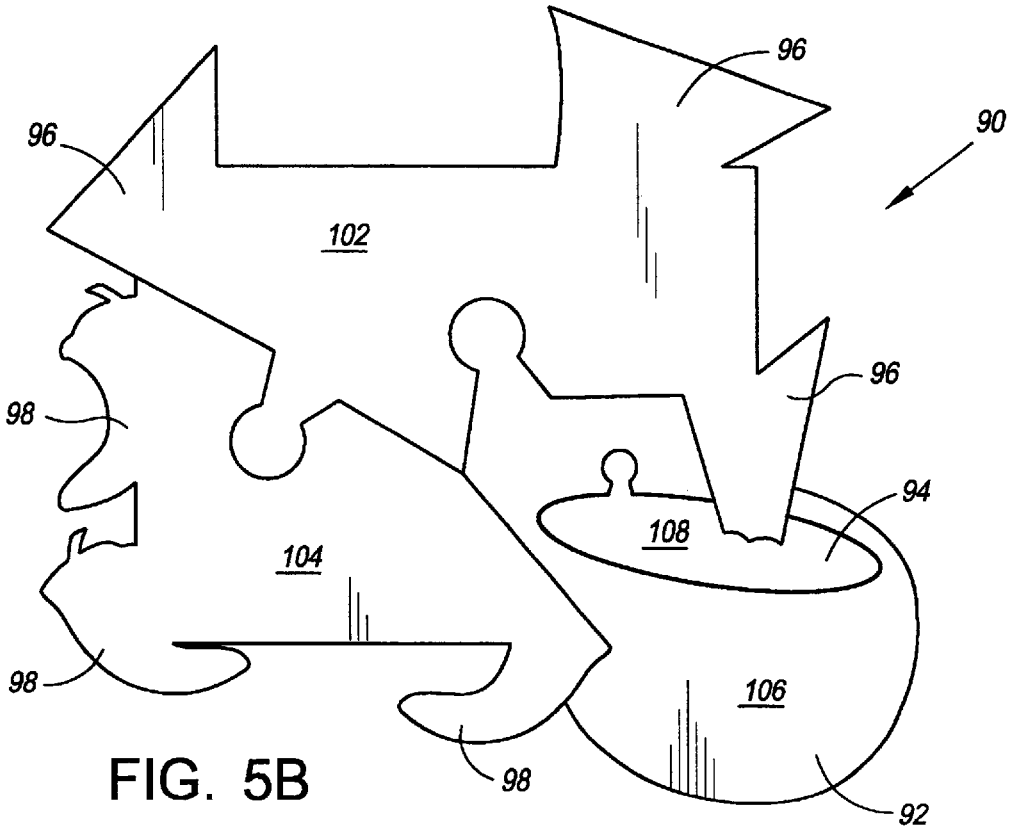
FIG. 5*b* is a plan view of the salsa graphic display of FIG. 5*a* illustrating the components of the graphic display.
Figure 5C:
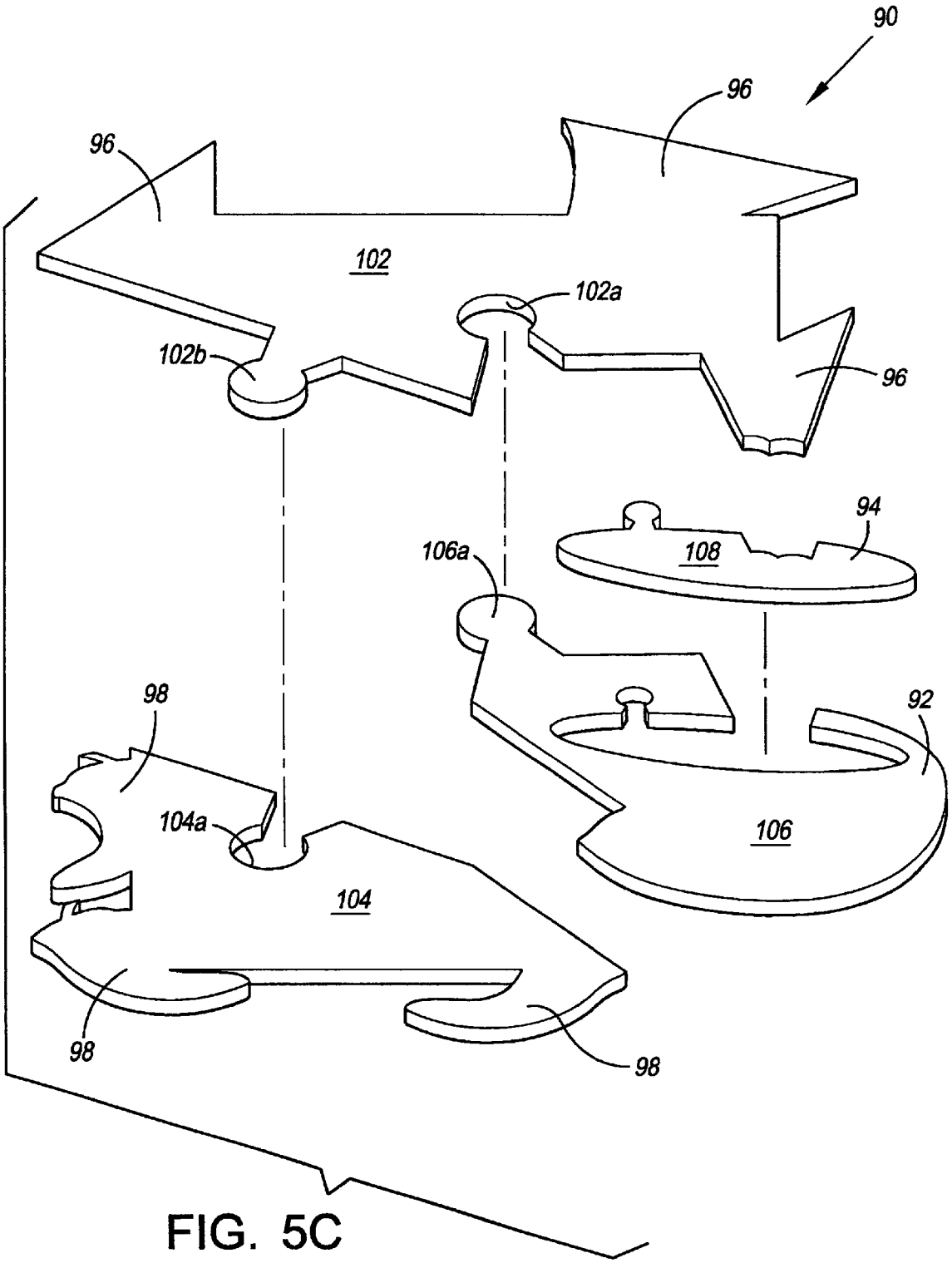
FIG. 5*c* is an exploded plan view of the components shown in FIG. 5*b;*

Referring now to FIGS. 5*a*–5*c*, an additional embodiment of mailer 10 is illustrated, and includes a salsa graphic display, generally identified by the numeral 90 which may be utilized for announcing a party. Graphic display 90 includes a bowl 92 containing salsa 94. Graphic display 90 also includes chips 96 and peppers 98 which extend beyond the perimeter of front sheet 14 and back sheet 16 of mailer 10.

Referring now to FIGS. 5*b* and 5*c*, graphic display 90 includes irregularly shaped and interlocking components 102–108. Component 102 forms all chips 96. Component 104 forms all peppers 98. Component 106 forms the bowl 92 and component 108 forms the salsa 94. By using components 102–108, individual colors can be utilized for the different elements of graphic display 90, and a single component can be utilized to form multiple similar features of display 90. For example, component 108 comprises all three chips 96, and component 104 comprises all three pepper 98. Components 102–108 interlock in a manner similar to components 40–52 and 72–78 previously described. For example, component 106 includes a male portion 106*a* for engaging a female portion 102*a* of component 102. Additionally, male portion 102*b* of component 102 engages a female portion 104*a* of component 104.

Figure 6A:
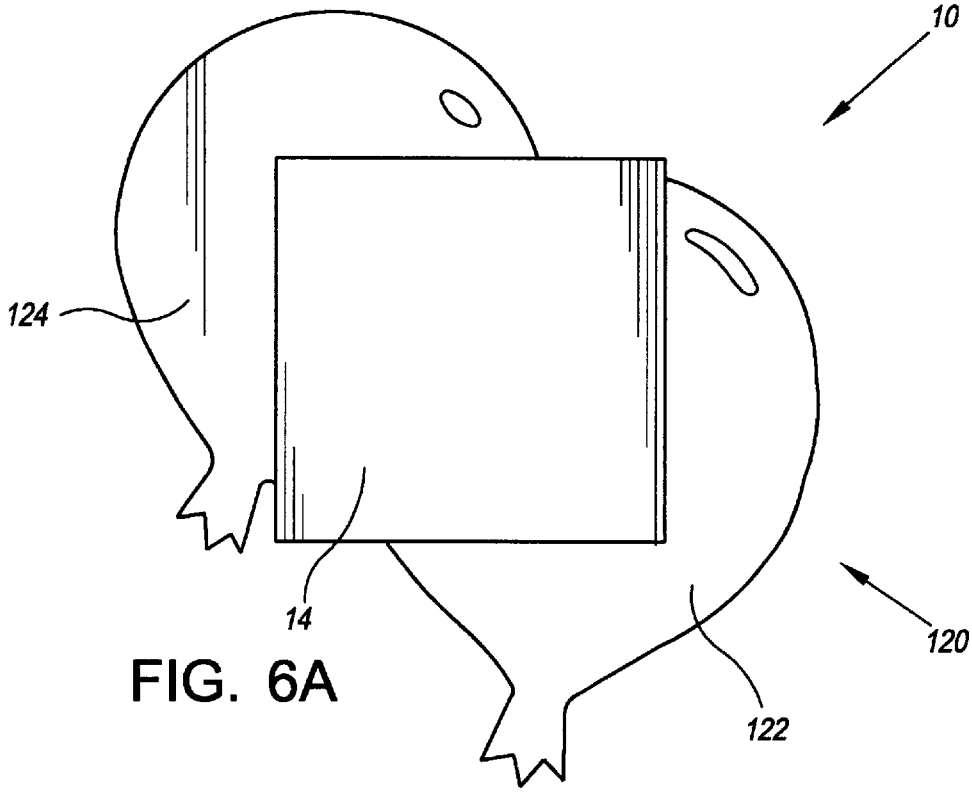
FIG. 6*a* is a plan view of a balloon mailer illustrating a representative embodiment of the present invention.
Figure 6B:
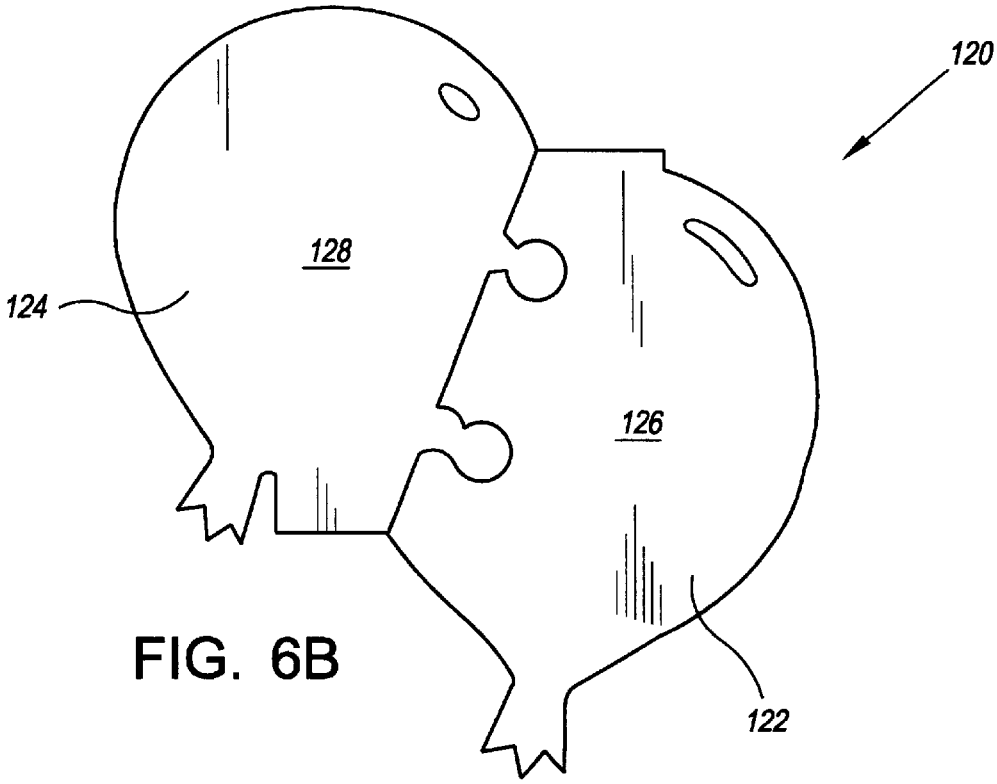
FIG. 6*b* is a plan view of the balloon graphic display of FIG. 6*a* illustrating the components of the graphic display.
Figure 6C:
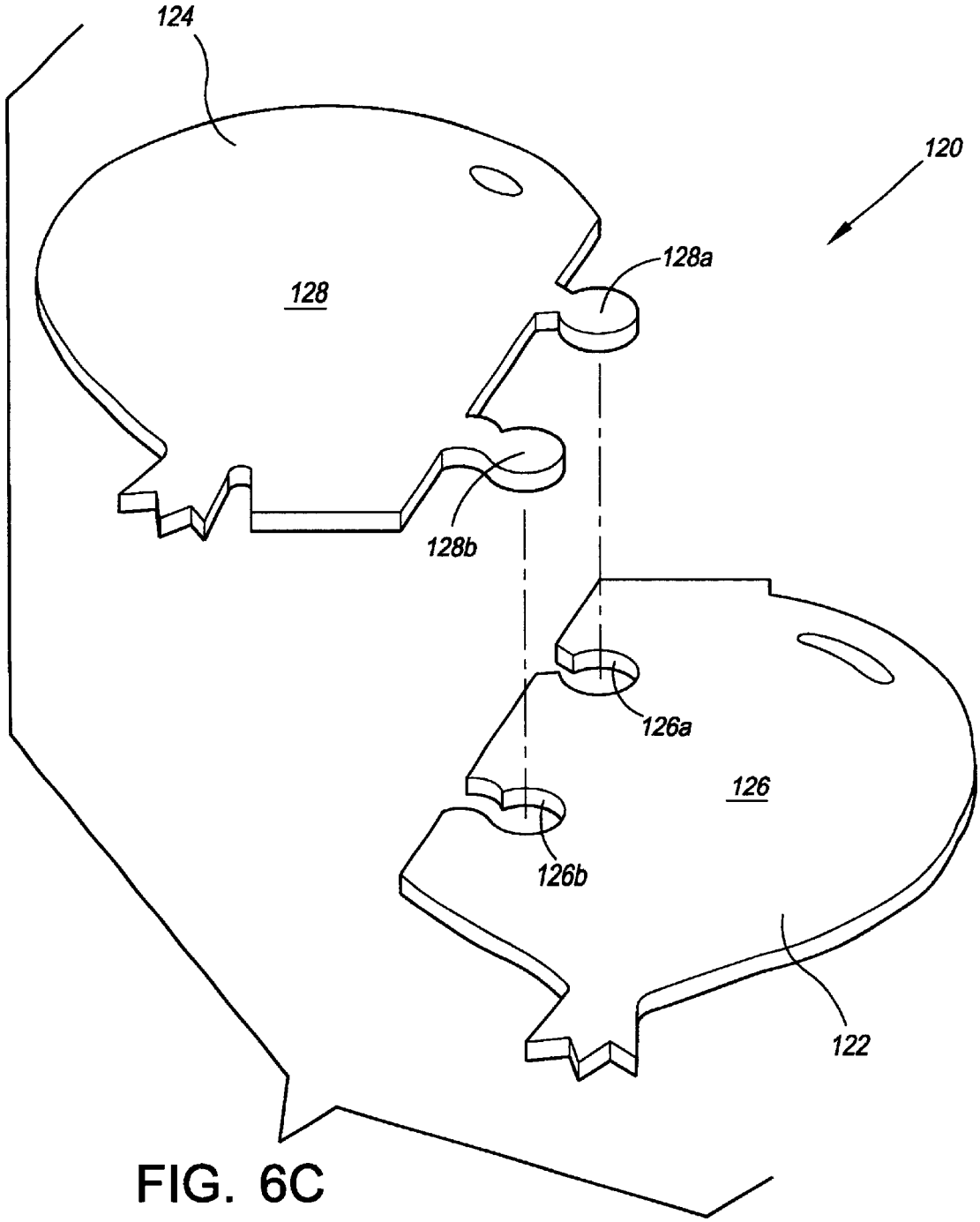
FIG. 6*c* is an exploded plan view of the components shown in FIG. 6*b*.

Referring now to FIGS. 6*a*–6*c*, an additional embodiment of the present mailer 10 is illustrated, and includes a balloon graphic display, generally identified by the numeral 120 which may be utilized for announcing a birthday party. Balloon display 120 includes balloons 122 and 124, portions of which extend beyond the perimeter of front sheet 14 and back sheet 16 of mailer 10.

Referring to FIGS. 6*b* and 6*c*, balloon display 120 includes irregularly shaped interlocking components 126 and 128. Component 128 includes male portions 128*a* and 128*b* which interlock with female apertures 126*a* and 126*b*, respectively of component 126.

Mailer 10 has been illustrated as including a flag graphic display 12, stork graphic display 60, salsa graphic display 90, and balloon graphic display 120, it being understood that numerous graphic displays can be utilized in combination with mailer 10, the four displays being illustrated are for illustrative purposes only, and not intended to limit the present invention.

Front sheet 14 and back sheet 16 each have a width associated between their respective outer face and inner face. Additionally, the graphic display associated with mailer 10 includes a width between its respective faces. The total combined thickness of a mailer 10 is about at least ⅛ inch, and is generally approximately ¼ inch thick.

Whereas the present invention has been described with respect to specific embodiments thereof, it will be understood that various changes and modifications will be suggested to one skilled in the art and it is intended to encompass such changes and modifications as fall within the scope of the appended claims.

What is claimed:

1. A mailer for transmission from a sender to a recipient, the recipient having an address, the mailer comprising:

a front sheet having a perimeter and inner and outer opposed faces;

said outer face of said front sheet adapted to receive the address of the recipient, said front sheet being disposed in a first plane;

a back sheet having a perimeter and inner and outer opposed faces, said back sheet being disposed in a second plane, spaced apart from and parallel to said first plane;

a graphic display disposed between said front sheet and said back sheet and adjacent to said inner face of said front sheet and said inner face of said back sheet and disposed in a third plane parallel to said first and second planes, said graphic display including projections extending within said third plane and outside said perimeter of said front sheet and outside said perimeter of said back sheet; and said graphic display including a plurality of irregularly shaped interlocking components.

2. The mailer of claim 1 wherein at least one of said plurality of irregularly shaped interlocking components includes an aperture for receiving another one of said plurality of irregularly shaped interlocking components.

3. The mailer of claim 1 wherein at least one of said plurality of irregularly shaped interlocking components includes a female portion and at least one of said plurality of irregularly shaped interlocking components includes a male portion for mating and interlocking with said female portion.

4. The mailer of claim 1 wherein said back sheet includes an envelope enclosure.

5. The mailer of claim 1 wherein said front sheet, said back sheet and said graphic display each has a thickness and the mailer has a combined total thickness of at least ⅛ inch.

6. The mailer of claim 1 wherein said graphic display includes flexible sheet material.

* * * * *